US010343408B2

(12) United States Patent
Honda

(10) Patent No.: US 10,343,408 B2
(45) Date of Patent: Jul. 9, 2019

(54) HEAD CLEANING MECHANISM AND INK-JET RECORDING APPARATUS PROVIDED WITH THE SAME

(71) Applicant: KYOCERA Document Solutions Inc., Osaka (JP)

(72) Inventor: Mitsunobu Honda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/114,627

(22) Filed: Aug. 28, 2018

(65) Prior Publication Data

US 2019/0111685 A1 Apr. 18, 2019

(30) Foreign Application Priority Data

Oct. 17, 2017 (JP) ..... 2017-200928

(51) Int. Cl.
*B41J 2/165* (2006.01)

(52) U.S. Cl.
CPC ..... *B41J 2/16552* (2013.01); *B41J 2/16508* (2013.01); *B41J 2/16538* (2013.01); *B41J 2/16541* (2013.01); *B41J 2/16544* (2013.01); *B41J 2/16585* (2013.01); *B41J 2002/16502* (2013.01); *B41J 2002/16558* (2013.01)

(58) Field of Classification Search
CPC ..... B41J 2/16517; B41J 2/16535; B41J 2/16552; B41J 2/16538; B41J 2/16541; B41J 2002/16558
See application file for complete search history.

(56) References Cited

U.S. PATENT DOCUMENTS

| | | | | |
|---|---|---|---|---|
| 8,573,742 | B2 * | 11/2013 | Petersen | B41J 2/16538 239/589 |
| 10,155,389 | B2 * | 12/2018 | Araki | B41J 2/16552 |
| 2018/0194140 | A1 * | 7/2018 | Araki | B41J 2/16552 |
| 2019/0111686 | A1 * | 4/2019 | Honda | B41J 2/16552 |

FOREIGN PATENT DOCUMENTS

| | | | | |
|---|---|---|---|---|
| EP | 02240326 | A * | 10/2010 | B41J 2/16538 |
| JP | 01275047 | A * | 11/1989 | B41J 2/16538 |
| JP | 2001-219559 | A | 8/2001 | |

* cited by examiner

*Primary Examiner* — Huan H Tran
(74) *Attorney, Agent, or Firm* — Stein IP, LLC

(57) ABSTRACT

A head cleaning mechanism includes a recording head and a wiper. The recording head includes an ink ejection face having an ink ejection region where a plurality of ink ejection openings for ejecting ink onto a recording medium are open. The wiper wipes the ink ejection face in a predetermined direction. The ink ejection face has, downstream of the ink ejection region in the wiping direction, a depressed portion extending in the head width direction perpendicular to the wiping direction. The depressed portion includes an upstream side inclined face which inclines upward from the ink ejection face to the downstream side in the wiping direction, and a downstream side inclined face which is arranged downstream of the upstream side inclined face in the wiping direction and which inclines downward to the downstream side in the wiping direction.

16 Claims, 12 Drawing Sheets

HEAD CLEANING MECHANISM AND INK-JET RECORDING APPARATUS PROVIDED WITH THE SAME

INCORPORATION BY REFERENCE

This application is based upon and claims the benefit of priority from the corresponding Japanese Patent Application No. 2017-200928 filed on Oct. 17, 2017, the contents of which are hereby incorporated by reference.

BACKGROUND

The present disclosure relates to a head cleaning mechanism including a recording head having ink ejection openings for ejecting ink onto a recording medium such as paper, and relates also to an ink-jet recording apparatus provided with such a head cleaning mechanism.

As recording apparatuses such as facsimile machines, copiers, and printers, ink-jet recording apparatuses, which form images by ejecting ink, are widely used for their ability to form high-definition images.

In such ink-jet recording apparatuses, fine ink droplets (hereinafter, referred to as mist) which are ejected together with ink droplets for recording an image, and splashed mist which is generated when ink droplets attach to the recording medium, attach to an ink ejection face on the recording head and solidify. If mist on the ink ejection face gradually increases and covers the ink ejection openings, it leads to, for example, degraded straightness in ink trajectory (curved flight) or ejection failure, and hence degraded printing performance of the recording head.

Thus, for the cleaning of the ink ejection face of the recording head, there is known a configuration to push out (purge) ink forcibly from the ink ejection openings and wipe the purged ink attached to the ink ejection face with a wiper as recovery operation for the recording head. In such ink-jet recording apparatuses, when the purged ink on the ink ejection face is wiped, the wiper moves along the ink ejection face with its tip end portion bent in a direction opposite to the wiping direction.

There are also known ink-jet apparatuses provided with a depressed portion for capturing ink on the ink ejection face, downstream of the ink ejection openings in the wiping direction. In such ink-jet apparatuses, when the wiper that has wiped the purged ink on the ink ejection face passes across the depressed portion for capturing ink, the ink at a tip end portion of the wiper is held (captured) in the depressed portion for capturing ink. It is thus possible to prevent the ink at the tip end portion of the wiper from splashing as a reaction of the bent wiper straightening when the wiper leaves the ink ejection face.

SUMMARY

According to one aspect of the present disclosure, a head cleaning mechanism includes a recording head and a wiper. The recording head includes an ink ejection face provided with an ink ejection region in which a plurality of ink ejection openings for ejecting ink onto a recording medium are open. The wiper wipes the ink ejection face in a predetermined direction. A depressed portion extending in the head width direction perpendicular to the wiping direction in which the wiper wipes the ink ejection face is provided on the ink ejection face, downstream of the ink ejection region in the wiping direction. The depressed portion includes an upstream side inclined face which inclines upward from the ink ejection face to the downstream side in the wiping direction, and a downstream side inclined face which is arranged downstream of the upstream side inclined face in the wiping direction and which is inclined downward to the downstream side in the wiping direction.

This and other objects of the present disclosure, and the specific benefits obtained according to the present disclosure, will become apparent from the description of embodiments which follows.

DETAILED DESCRIPTION

Embodiments of the present disclosure will be described below with reference to the accompanying drawings.

Figure 1:
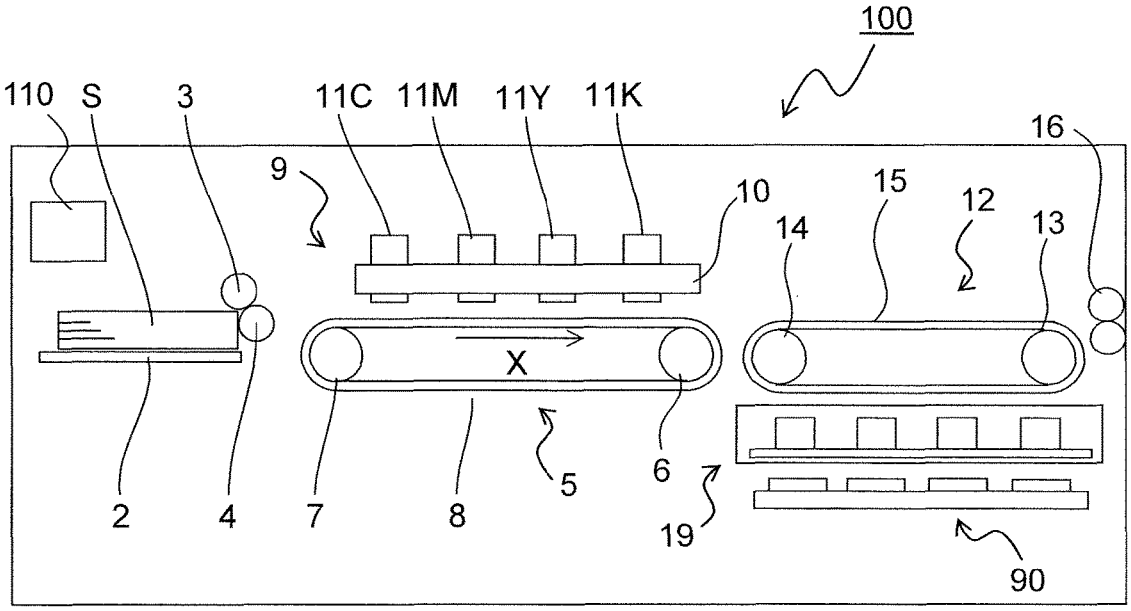
FIG. 1 is a diagram showing the structure of an ink-jet recording apparatus provided with a head cleaning mechanism according to one embodiment of the present disclosure.

As shown in FIG. 1, in an ink-jet recording apparatus 100 according to one embodiment of the present disclosure, in a left-side part, a sheet feed tray 2 which houses sheets S (recording media) is provided. At one end part of the sheet feed tray 2, there are provided a sheet feed roller 3 that coveys and feeds the housed sheets S one after another, starting with the top sheet S, to a first conveying unit 5, which will be described later, and a driven roller 4 that is in pressed contact with the sheet feed roller 3 to rotate by following it.

On the downstream side (right side in FIG. 1), in the sheet conveying direction (arrow X direction), of the sheet feed roller 3 and the driven roller 4, the first conveying unit 5 and a recording portion 9 are arranged. The first conveying unit 5 is configured to include a first driving roller 6, a first driven roller 7, and a first conveying belt 8 which is stretched between the first driving roller 6 and the first driven roller 7. According to a control signal from a control portion 110 which controls the whole ink-jet recording apparatus 100, the first driving roller 6 is driven to rotate in the clockwise direction and thus a sheet S held on the first conveying belt 8 is conveyed in the arrow X direction.

Figure 2:
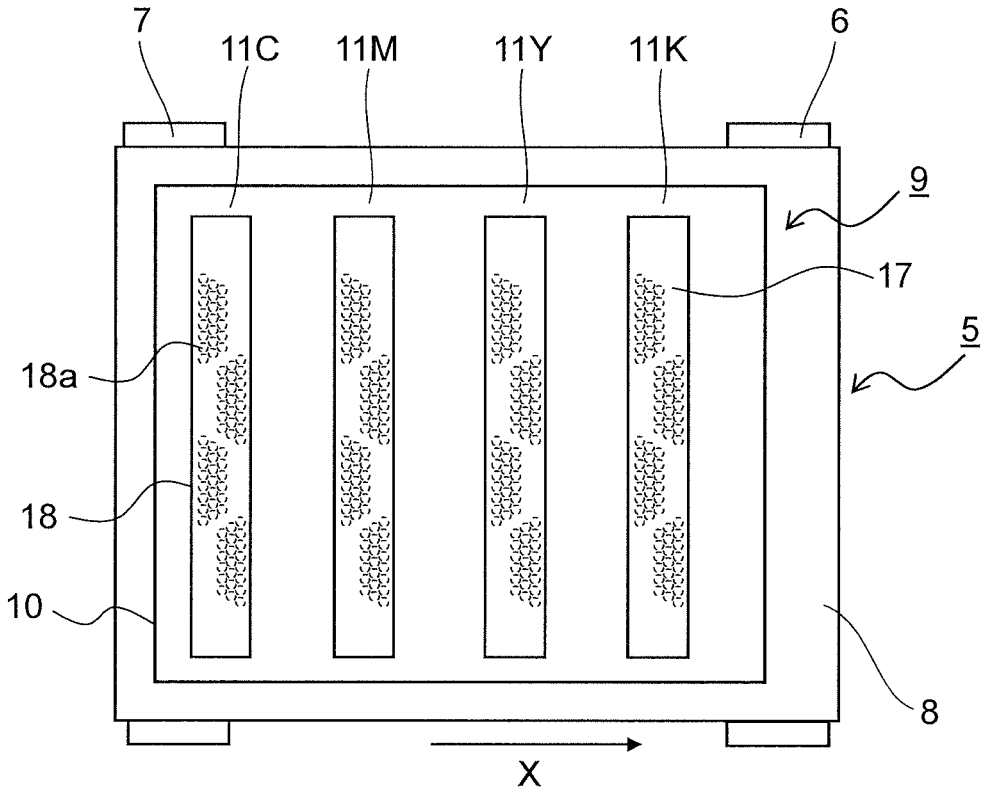
FIG. 2 is a diagram showing a first conveying unit and a recording portion of the ink-jet recording apparatus shown in FIG. 1 as seen from above.

The recording portion 9 includes a head housing 10 and line heads 110, 11M, 11Y and 11K which are held on the head housing 10. These line heads 11C to 11K are supported at such a height that a predetermined gap (for example, larger than or equal to 1.2 mm but smaller than or equal to 1.5 mm) is formed relative to the conveying face of the first conveying belt 8. As shown in FIG. 2, the line heads 11C to 11K include one or more (here, one) recording heads 17 which extend in the sheet width direction (up-down direction in FIG. 2) perpendicular to the sheet conveying direction.

Figure 3:
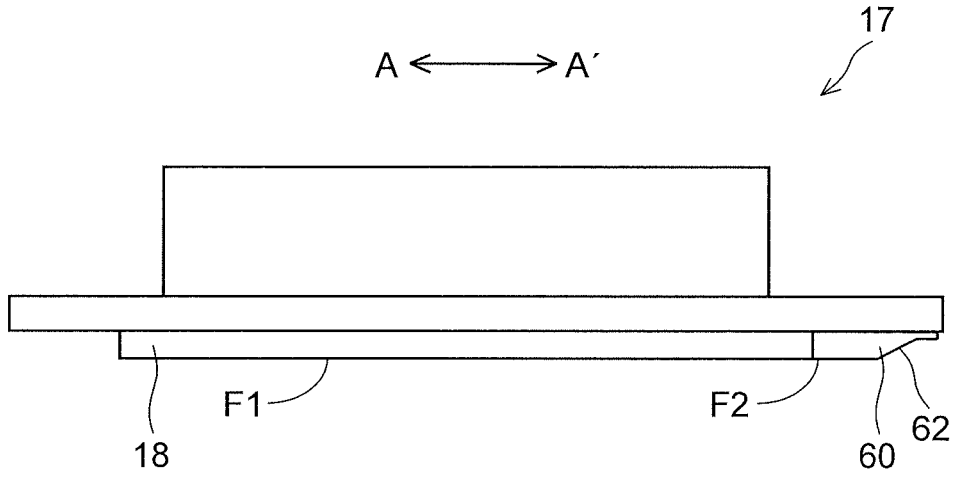
FIG. 3 is a diagram showing a recording head which constitutes line heads of the recording portion.
Figure 4:
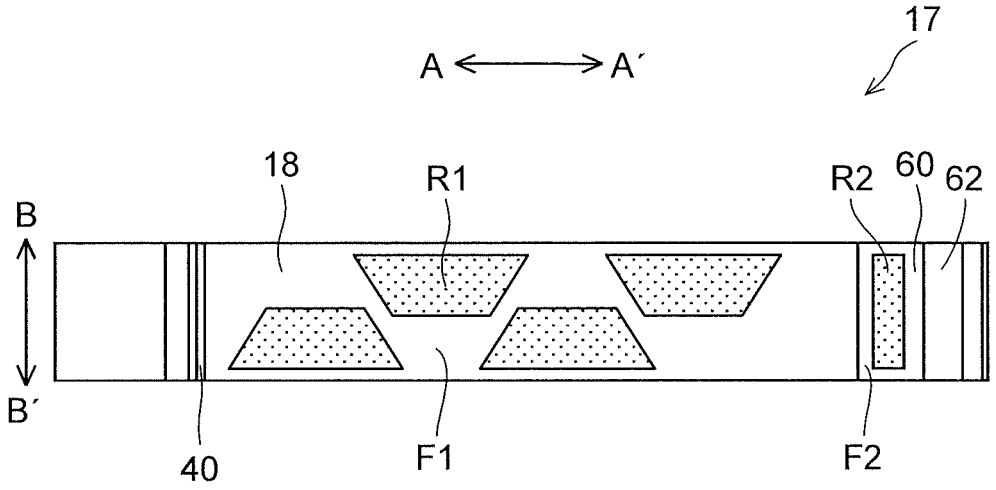
FIG. 4 is a diagram showing the recording head as seen from the ink ejection face side.

As shown in FIGS. 3 and 4, at an ink ejection face F1 on a head portion (ink ejection head portion) 18 of the recording head 17, there is provided an ink ejection region R1 in which a number of ink ejection openings 18*a* (see FIG. 2) are arrayed.

To the recording head 17 constituting the line heads 110 to 11K, ink of four colors (cyan, magenta, yellow, and black) stored in ink tanks (unillustrated) is supplied, ink of the different colors being supplied to corresponding ones of the line heads 11C to 11K respectively.

According to the control signal from the control portion 110 (see FIG. 1), and based on image data received from an external computer or the like, the recording head 17 ejects ink from the ink ejection openings 18*a* toward the sheet S which is conveyed while being held by absorption on the conveying face of the first conveying belt 8. With this, on the sheet S on the first conveying belt 8, a color image having ink of four colors, namely cyan, magenta, yellow and black, overlaid together is formed.

On the recording head 17, a cleaning liquid supplying member (cleaning liquid supplying head portion) 60 for supplying a cleaning liquid is provided. The cleaning liquid supplying member 60 is arranged adjacent to the head portion 18, on its upstream side (right side in FIG. 3) in the wiping direction of a wiper 35, which will be described later. The cleaning liquid supplying member 60 has a cleaning liquid supplying face F2 which include a cleaning liquid supplying region R2 in which a number of cleaning liquid supplying openings 60*a* (see FIG. 5) for supplying the cleaning liquid are arrayed. In the head portion 18, at least the ink ejection face F1 is formed of stainless steel (SUS). In the cleaning liquid supplying member 60, at least the cleaning liquid supplying face F2 is formed of, for example, SUS or resin.

The cleaning liquid supplying face F2 is formed so as to be flush with the ink ejection face F1. In a part of the cleaning liquid supplying member 60 upstream (right-side in FIG. 3) of the cleaning liquid supplying face F2 in the wiping direction, an inclined face 62 is formed.

Preferably, the cleaning liquid is a solution containing components similar to those of ink, that is, a liquid composition mainly containing a solvent component and water to which a surfactant, an antiseptic and antifungal agent, and the like are added as necessary.

Figure 5:
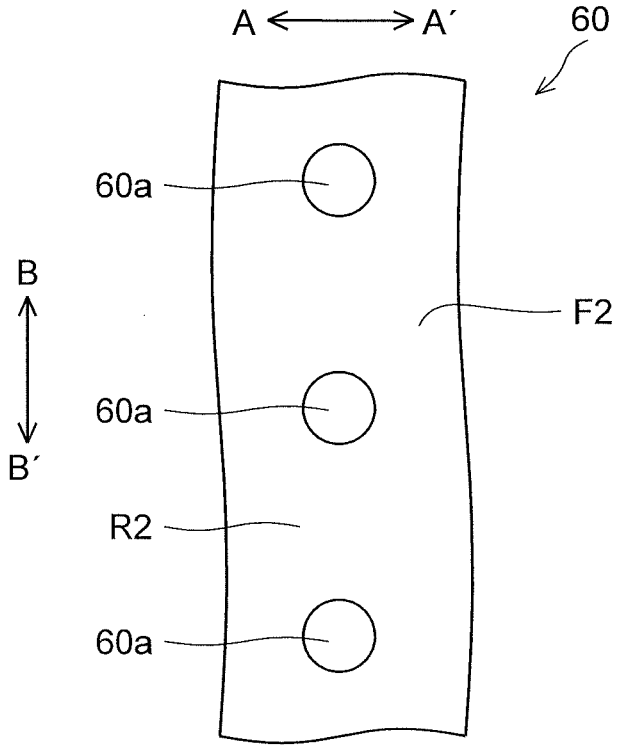
FIG. 5 is a diagram showing cleaning liquid supplying openings in a cleaning liquid supplying member on the recording head as seen from below.

As shown in FIG. 5, the cleaning liquid supplying openings 60*a* are arranged, for example, with a pitch of 1 mm along the head width direction (arrow BB' direction, that is, the direction perpendicular to the wiping direction). FIG. 5 only shows one row of a plurality of cleaning liquid supplying openings 60*a* which are arranged along the head width direction, but a plurality of such rows may be provided adjacent to each other in the wiping direction (arrow A direction).

Figure 6:
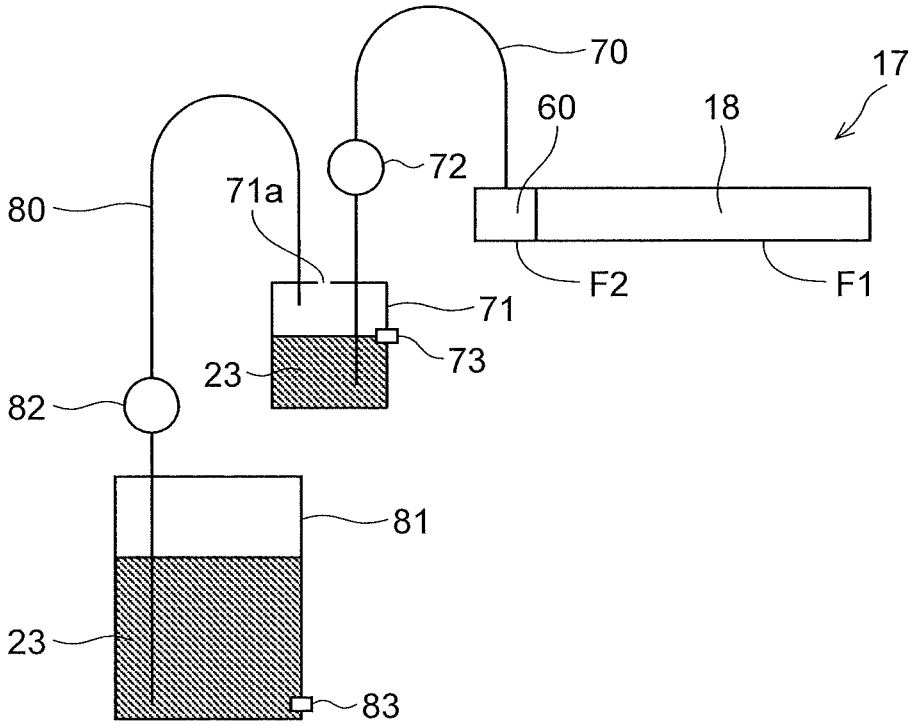
FIG. 6 is a diagram showing the structure of and around the recording head, a tank, and a replenishing tank.

As shown in FIG. 6, the cleaning liquid supplying openings 60*a* (see FIG. 5) in the cleaning liquid supplying member 60 are connected to a downstream end of a cleaning liquid supplying path 70 which comprises a tube through which cleaning liquid 23 passes. An upstream end of the cleaning liquid supplying path 70 is connected to a subtank 71 in which is stored the cleaning liquid 23 for supply to the cleaning liquid supplying member 60. The upstream end of the cleaning liquid supplying path 70 is immersed in the cleaning liquid 23. The cleaning liquid supplying path 70 is provided with a supplying pump 72 that pumps up the cleaning liquid 23 from the subtank 71 to feed it to the cleaning liquid supplying member 60. In the diagram, the cleaning liquid 23 is indicated by hatching to facilitate understanding.

The subtank 71 is connected to a downstream end of a cleaning liquid replenishing path 80 comprising a tube through which the cleaning liquid 23 passes. An upstream end of the cleaning liquid replenishing path 80 is connected to a main tank 81 in which is stored the cleaning liquid 23 for supply to the subtank 71. The upstream end of the cleaning liquid replenishing path 80 is immersed in the cleaning liquid 23. The cleaning liquid replenishing path 80 is provided with a replenishing pump 82 that pumps up the cleaning liquid 23 from the main tank 81 to feed it to the subtank 71. For the supplying pump 72 and the replenishing pump 82, for example, a tube pump, a syringe pump, or a diaphragm pump can be used. The supplying pump 72 is so configured that it can switch, when the supply is stopped, between a state where the path between an inflow port and an outflow port of the supplying pump 72 is blocked and a state where those ports communicate with each other. The detailed structure of and around the cleaning liquid supplying member 60, the subtank 71 and the main tank 81 will be described later.

In this ink-jet recording apparatus 100, to clean the ink ejection face F1 on the recording head 17, at the start of printing after a long out-of-operation period and during intermissions of printing operation, ink is discharged forcibly from the ink ejection openings 18*a* in all the recording heads 17. Then the cleaning liquid 23 is supplied through the cleaning liquid supplying openings 60*a* (see FIG. 5) in all the recording heads 17 to the cleaning liquid supplying region R2, and the ink ejection face F1 is wiped with the wiper 35, which will be described later, in preparation for the next printing operation.

As shown back in FIG. 1, on a downstream side (right side in FIG. 1) of the first conveying unit 5 in the sheet conveying direction, a second conveying unit 12 is arranged. The second conveying unit 12 is configured to include a second driving roller 13, a second driven roller 14, and a second conveying belt 15 which is stretched between the second driving roller 13 and the second driven roller 14. The second driving roller 13 is driven to rotate in the clockwise direction and thus a sheet S held on the second conveying belt 15 is conveyed in the arrow X direction.

The sheet S with an ink image recorded on it at the recording portion 9 is conveyed to the second conveying unit 12. While the sheet S passes through the second conveying unit 12, the ink ejected on the surface of the sheet S is dried. Under the second conveying unit 12, a maintenance unit 19 and a cap unit 90 are arranged. When wiping operation is performed by the wiper 35 as mentioned above, the first conveying unit 5 descends. Then the maintenance unit 19 moves to under the recording portion 9, wipes off the ink discharged forcibly from the ink ejection openings 18*a* on the recording head 17 and the cleaning liquid 23 supplied from the cleaning liquid supplying openings 60*a*, and collects the ink and the cleaning liquid 23 wiped off. When capping the ink ejection face F1 (see FIG. 3) on the recording head 17, the first conveying unit 5 descends. Then the cap unit 90 horizontally moves to under the recording portion 9, and then moves upward to be fitted to the lower face of the recording head 17.

On the downstream side of the second conveying unit 12 in the sheet conveying direction, there is provided a discharge roller pair 16 which discharges the sheet S with an image recorded on it to outside the apparatus main body. On the downstream side of the discharge roller pair 16, there is provided a discharge tray (unillustrated) on which the sheets S discharged outside the apparatus main body is stacked.

The maintenance unit 19 includes a plurality of wipers 35 (see FIG. 10) which are movable along the ink ejection face F1, a substantially rectangular carriage (unillustrated) on which the plurality of wipers 35 are fixed, and a supporting frame (unillustrated) which supports the carriage. The carriage (unillustrated) is supported so as to be slidable in the arrow AA' direction relative to the supporting frame (unillustrated). The wipers 35, the recording heads 17, and the control portion 110 constitute a head cleaning mechanism.

The wiper 35 is an elastic member (for example, a rubber member made of EPDM) for wiping the cleaning liquid 23 which is supplied from the cleaning liquid supplying openings 60*a* (see FIG. 5) in each recording head 17. The wiper 35 is kept in pressed contact with a part (here, the inclined face 62) of the cleaning liquid supplying member 60 upstream of the cleaning liquid supplying region R2 (see FIG. 4) in the wiping direction. As the carriage (unillustrated) moves, the wiper 35 wipes the cleaning liquid supplying face F2 and the ink ejection face F1 in the predetermined direction (arrow A direction).

Next, the structures of and around the cleaning liquid supplying member 60, the subtank 71, and the main tank 81 will be described in detail.

As shown in FIG. 6, the subtank 71 is provided with an atmospheric open port 71*a* for equalizing the pressure in its internal space with the atmospheric pressure. At a predetermined position in the subtank 71, a first detection sensor 73 for sensing the cleaning liquid 23 is provided. The first detection sensor 73 has an electrode pair (unillustrated) to which a voltage is applied and which is arranged inside the subtank 71. The first detection sensor 73 can, based on whether a current is present between the electrodes, sense the presence or the absence of the cleaning liquid 23. When the first detection sensor 73 senses the absence of the liquid (absence of the current), the cleaning liquid 23 is supplied by the replenishing pump 82 from the main tank 81 to the subtank 71 until the presence of the liquid (presence of the current) is sensed. With this, the liquid level (top face) of the cleaning liquid 23 inside the subtank 71 is substantially kept constant.

In a lower part of the main tank 81, a second detection sensor 83 for sensing the cleaning liquid 23 is provided. The second detection sensor 83 has an electrode pair (unillustrated) to which a voltage is applied and which is arranged inside the main tank 81. The second detection sensor 83 can, based on whether a current is present between the electrodes, sense the presence or the absence of the cleaning liquid 23. When the second detection sensor 83 senses the absence of the liquid, a display panel (unillustrated) of the ink-jet recording apparatus 100 indicates that the main tank 81 has become empty. With this, a user or an operator replaces the main tank 81 with a new one, or replenishes the main tank 81 with the cleaning liquid 23.

Figure 7:
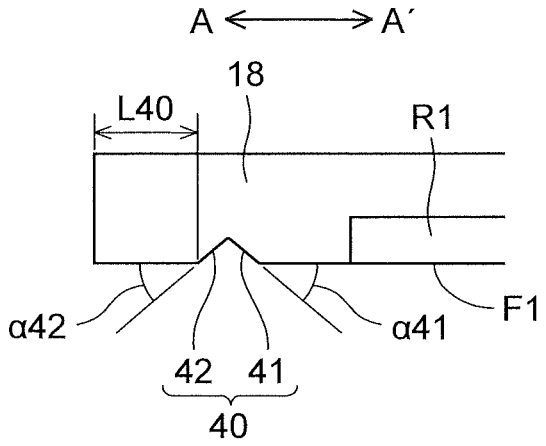
FIG. 7 is a diagram showing the structure of and around a depressed portion on the recording head.

As shown in FIGS. 4 and 7, on the ink ejection face F1, on the downstream side (left side in FIG. 4) of the ink ejection region R1 in the wiping direction, there is provided a depressed portion 40 which extends in the head width direction (arrow BB' direction). The depressed portion 40 is formed to extend up to the opposite ends of the ink ejection face F1 in the head width direction. As shown in FIG. 7, the depressed portion 40 is arranged at a first distance L40 from a downstream-side end part of the ink ejection face F1 in the wiping direction. A horizontal face is provided between the depressed portion 40 and the downstream-side end part of the ink ejection face F1.

The depressed portion 40 includes an upstream side inclined face 41 which inclines upward from the ink ejection face F1 to the downstream side in the wiping direction, and a downstream side inclined face 42 which is arranged on the downstream side of the upstream side inclined face 41 in the wiping direction and which is inclined downward to the downstream side in the wiping direction. The upstream side inclined face 41 and the downstream side inclined face 42 are provided continuously, and the depressed portion 40 is formed in a triangular shape as seen in a cross-sectional view from the head width direction.

The upstream side inclined face 41 and the downstream side inclined face 42 are each formed to have a length of approximately 2 to 3 mm along the inclination direction.

Figure 8:
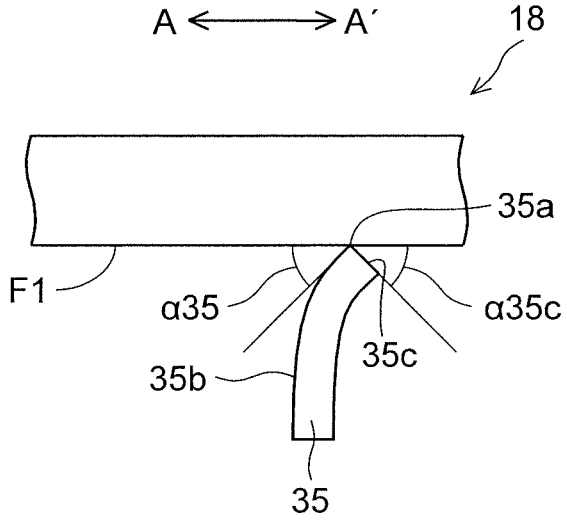
FIG. 8 is a diagram showing a state where a wiper is moving in the arrow A direction while staying in pressed contact with the ink ejection face.

As shown in FIGS. 7 and 8, an upstream side inclination angle $\alpha$41 of the upstream side inclined face 41 to the ink ejection face F1 is formed to be smaller than a tip end face inclination angle $\alpha$35*c* of a tip end face 35*c* of the wiper 35 to the ink ejection face F1 in a state (state in FIG. 8) where the wiper 35 is wiping the ink ejection face F1. The difference in angle between the upstream side inclination angle $\alpha$41 and the tip end face inclination angle $\alpha$35*c* is smaller than or equal to five degrees.

Specifically, the tip end face inclination angle $\alpha$35*c* of the wiper 35 in a state where the wiper 35 is wiping the ink ejection face F1 is approximately 45 degrees. The upstream side inclination angle $\alpha$41 of the upstream side inclined face 41 to the ink ejection face F1 is set to approximately 40 degrees. When the wiper 35 passes across the upstream side inclined face 41, an edge portion 35*a* on the downstream side of a tip end of the wiper 35 in the wiping direction moves while keeping contact with the upstream side inclined face 41.

In a state where the edge portion 35*a* at the tip end of the wiper 35 touches a connecting portion between the upstream side inclined face 41 and the downstream side inclined face 42 (that is, in a state where the wiper 35 has entered the depressed portion 40 most deeply), an inclination angle (bend) of the tip end portion of the wiper 35 becomes smaller by several degrees (approximately two degrees) than in a state where the wiper 35 is wiping the ink ejection face F1.

A downstream side inclination angle α42 of the downstream side inclined face 42 to the ink ejection face F1 is formed to be smaller than a pressed contact angle α35 of the tip end portion of the wiper 35 to the ink ejection face F1 in a state where the wiper 35 is wiping the ink ejection face F1. The difference in angle between the downstream side inclination angle α42 and the pressed contact angle α35 is smaller than or equal to five degrees.

Specifically, the pressed contact angle α35 of the wiper 35 in a state where the wiper 35 is wiping the ink ejection face F1 is set to approximately 45 degrees. The downstream side inclination angle α42 of the downstream side inclined face 42 to the ink ejection face F1 is set to approximately 40 degrees. Thus, when the wiper 35 passes across the downstream side inclined face 42, the edge portion 35*a* at the tip end of the wiper 35 moves while keeping contact with the downstream side inclined face 42.

The wiper 35 is formed to be a little longer than the ink ejection face F1 in the arrow BB' direction (head width direction), and is formed to have a thickness of about 2 to 3 mm in the arrow AA' direction. The wiper 35 has a wiping face 35*b* which is arranged toward the downstream side in the wiping direction (arrow A direction) and which wipes the ink ejection face F1, and the tip end face 35*c* mentioned above.

Next, recovery operation for the recording head 17 using the maintenance unit 19 in the ink-jet recording apparatus 100 according to this embodiment will be described. Recovery operation for the recording head 17 described below is performed by controlling the operation of the recording head 17, the maintenance unit 19, the supplying pump 72, and the like based on the control signal from the control portion 110 (see FIG. 1).

Figure 9:
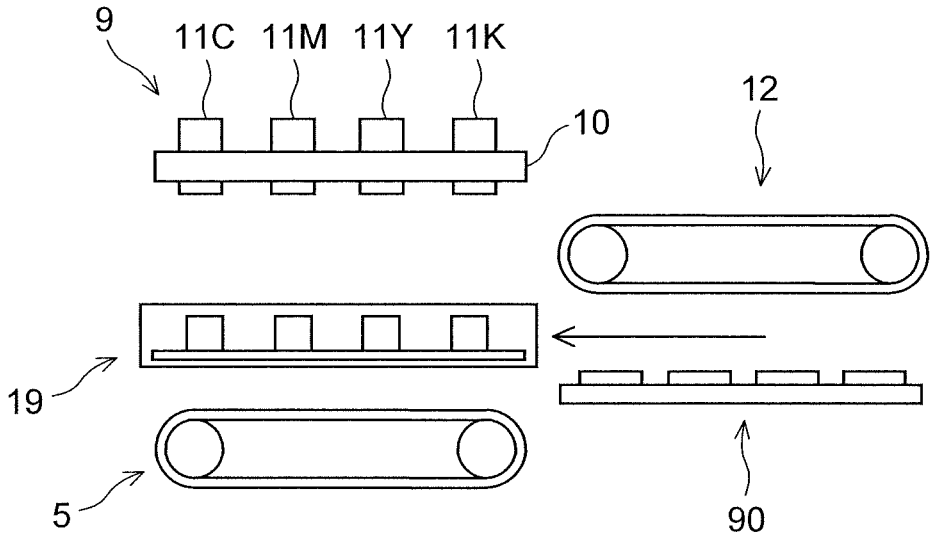
FIG. 9 is a diagram showing a state where a maintenance unit is arranged under the recording portion.

When recovery operation for the recording head 17 is performed, as shown in FIG. 9, the control portion 110 (see FIG. 1) first descends the first conveying unit 5 located under the recording portion 9. The control portion 110 then moves the maintenance unit 19 arranged under the second conveying unit 12 horizontally to arrange it between the recording portion 9 and the first conveying unit 5. In this state, the wiper 35 (see FIG. 10) of the maintenance unit 19 is arranged below the ink ejection face F1 and the cleaning liquid supplying face F2 (see FIG. 10) of the recording head 17.

Figure 10:
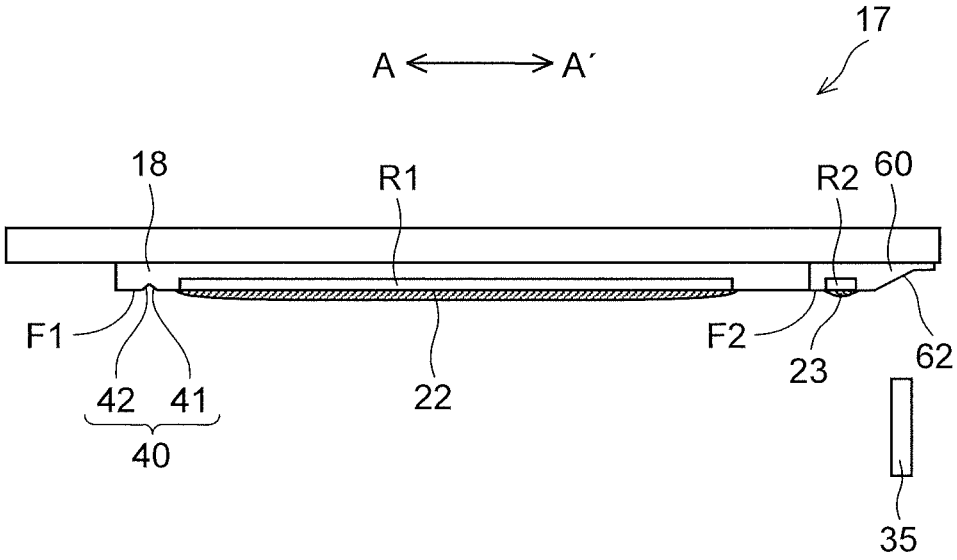
FIG. 10 is a diagram showing a state where the wiper is arranged under the recording head.

Cleaning Liquid Supplying Operation:

Prior to wiping operation (which will be described later), the control portion 110 (see FIG. 1) drives (turns on) the supplying pump 72 (see FIG. 6), and the cleaning liquid 23 is supplied to the recording heads 17 as shown in FIG. 10. Once a predetermined amount of the cleaning liquid 23 is supplied, the supplying pump 72 is stopped (turned off), and the path between the inflow port and the outflow port is blocked.

Ink Pushing Out Operation:

Prior to wiping operation (which will be described later), the control portion 110 (see FIG. 1) supplies ink 22 to the recording head 17 as shown in FIG. 10. The supplied ink 22 is pushed (purged) forcibly out of the ink ejection openings 18*a*. By this purging operation, thickened ink, foreign matter and air bubbles inside the ink ejection openings 18*a* are discharged from the ink ejection openings 18*a*. Here, the purged ink 22 is pushed out to the ink ejection face F1 along the shape of the ink ejection region R1 in which the ejection openings 18*a* lie. In the diagram, the ink (purged ink) 22 is indicated by hatching to facilitate understanding.

Figure 11:
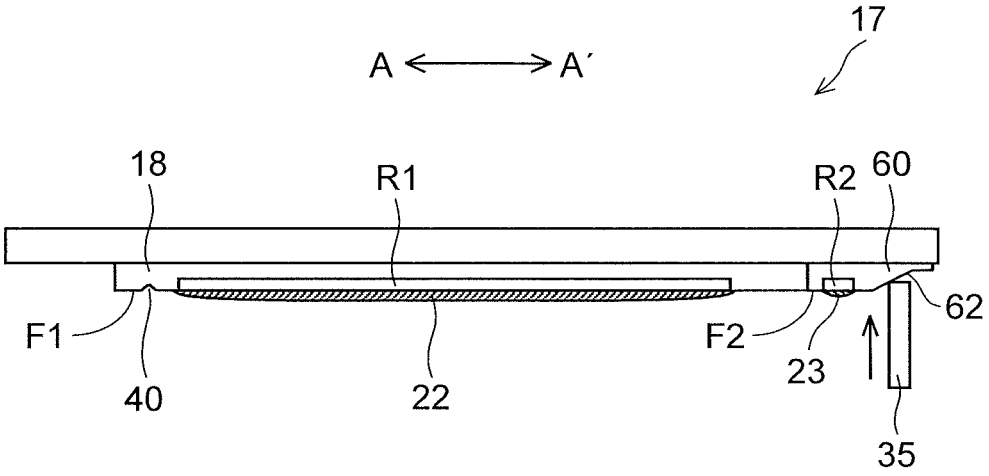
FIG. 11 is a diagram showing a state where the wiper is ascended from the state in FIG. 10 to be pressed into contact with the cleaning liquid supplying member.

Wiping Operation:

The control portion 110, as shown in FIG. 11, ascends the wiper 35 so that the wiper 35 makes contact with the inclined face 62 of the cleaning liquid supplying member 60 of the recording head 17 with a predetermined pressure. The wiper 35, when it has just ascended, does not necessarily need to be in pressed contact with the inclined face 62. That is, the wiper 35 may be ascended at a position further to the right in FIG. 11.

Figure 12:
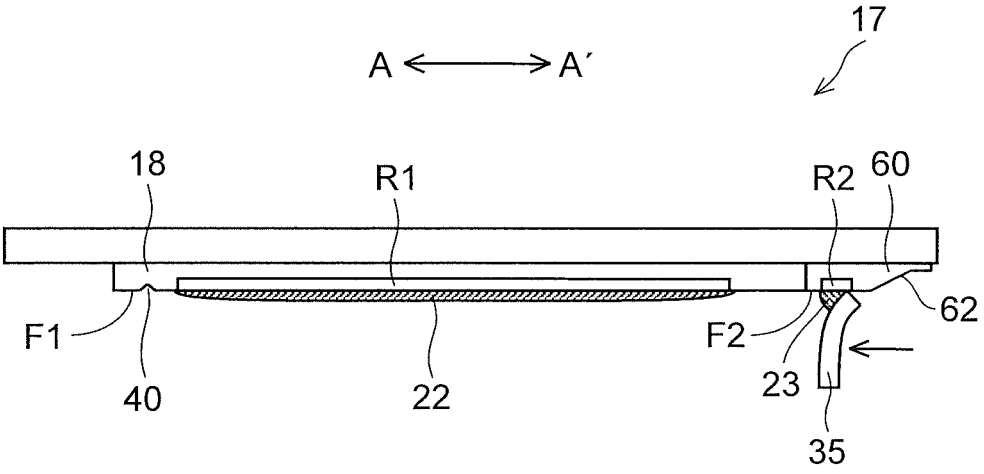
FIG. 12 is a diagram showing a state where the wiper is moved in the arrow A direction from the state in FIG. 11, while staying in pressed contact with the cleaning liquid supplying member.

The control portion 110 moves the wiper 35, which is in a state where the tip end of the wiper 35 is in pressed contact with the inclined face 62 of the cleaning liquid supplying member 60, in the direction of the ink ejection region R1 (arrow A direction), as shown in FIG. 12, along the cleaning liquid supplying face F2. With this, the wiper 35 moves in the direction of the ink ejection region R1 while holding the cleaning liquid 23. Here, the tip end portion of the wiper 35 bends to the side (arrow A' direction) opposite to the wiping direction.

When the tip end of the wiper 35 passes the cleaning liquid supplying region R2, the path between the inflow port and the outflow port of the supplying pump 72 is switched to a communicating state.

Figure 13:
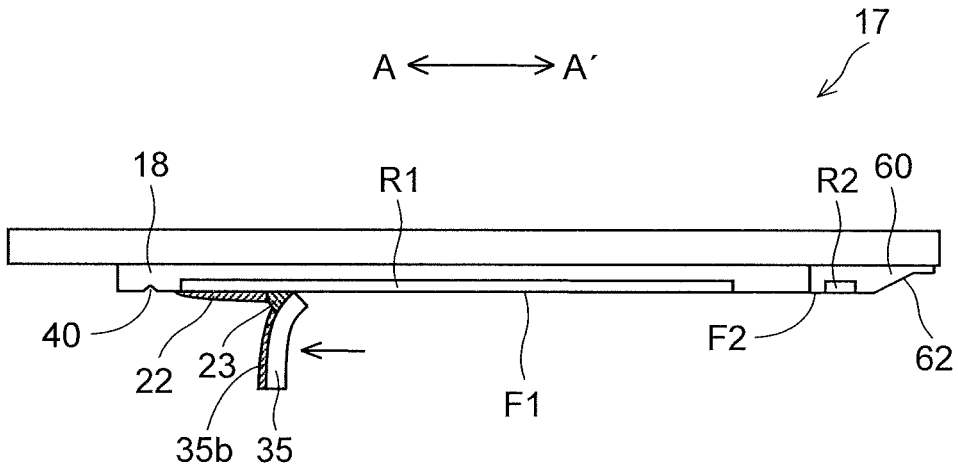
FIG. 13 is a diagram showing a state where the wiper is moved further in the arrow A direction from the state in FIG. 12.

As shown in FIG. 13, the wiper 35, while keeping holding the cleaning liquid 23 and the purged ink 22, moves on the ink ejection face F1 leftward (in the arrow A direction). Here, ink droplets (waste ink) which have attached to the ink ejection face F1 and solidified are dissolved by the cleaning liquid 23 and the purged ink 22 and are wiped off by the wiper 35. The excess cleaning liquid 23 and purged ink 22 which cannot be held at the tip end portion of the wiper 35 flows down the wiping face 35*b* of the wiper 35.

Figure 14:
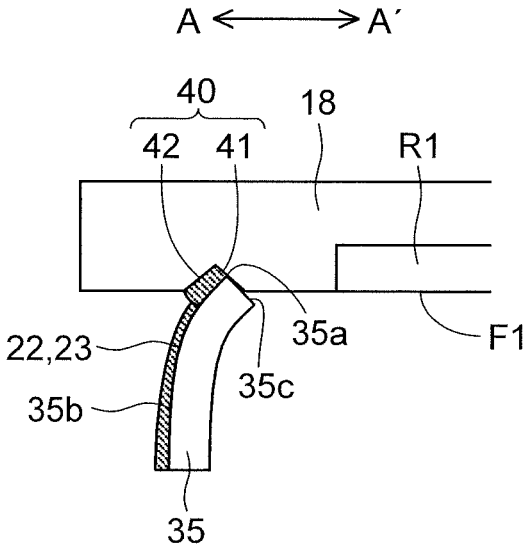
FIG. 14 is a diagram showing a state where the wiper is passing across an upstream side inclined face.
Figure 15:
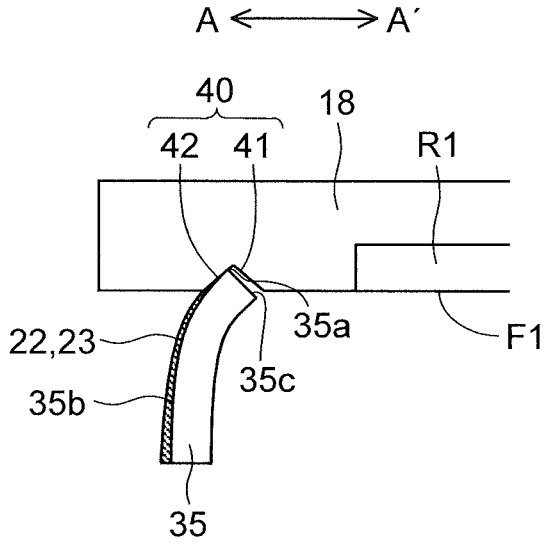
FIG. 15 is a diagram showing a state where the wiper is passing across a downstream side inclined face.
Figure 16:
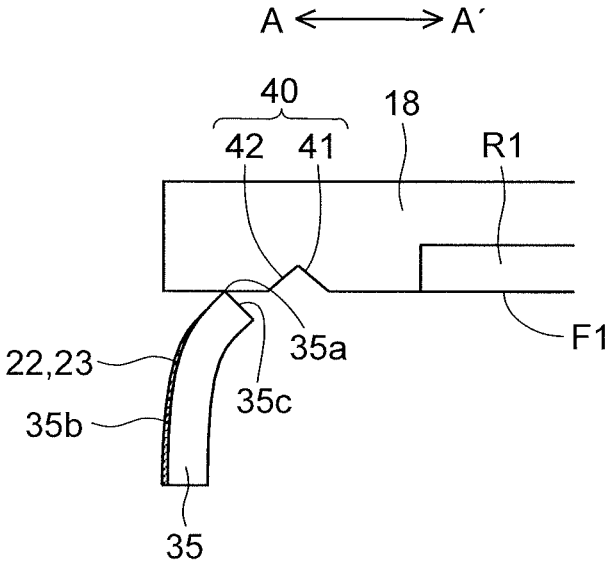
FIG. 16 is a diagram showing a state where the wiper is moved further in the arrow A direction from the state in FIG. 15.

Then, the wiper 35 moves further leftward (in the arrow A direction) and passes across the depressed portion 40. Here, as shown in FIG. 14, when the wiper 35 passes across the upstream side inclined face 41, the edge portion 35*a* at the tip end of the wiper 35 moves while keeping contact with the upstream side inclined face 41. As shown in FIG. 15, when the wiper 35 passes across the downstream side inclined face 42, the edge portion 35*a* at the tip end of the wiper 35 moves while keeping contact with the downstream side inclined face 42. The purged ink 22 and the cleaning liquid 23 at the tip end portion of the wiper 35 squeezed between the downstream side inclined face 42 and the wiper 35 are pushed out of the depressed portion 40 and flows downward. Thus, as shown in FIG. 16, after the wiper 35 passes the downstream side inclined face 42, hardly any of the purged ink 22 and the cleaning liquid 23 is left at, or attached to, the tip end portion of the wiper 35.

The control portion 110 may make the moving speed of the wiper 35 when it passes across the downstream side inclined face 42 lower than the moving speed of the wiper 35 when it moves on the ink ejection face F1. Also, the control portion 110 may stop the wiper 35 momentarily when the wiper 35 passes across the downstream side inclined face 42. The control portion 110 may also make the moving speed of the wiper 35 when it passes across the upstream side inclined face 41 lower than the moving speed of the wiper 35 when it moves on the ink ejection face F1.

Figure 17:
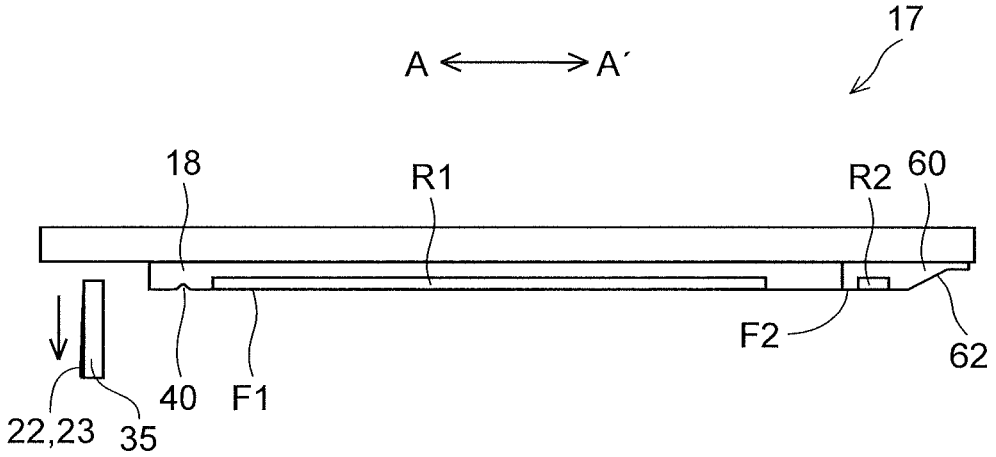
FIG. 17 is a diagram showing a state where the wiper is moved further in the arrow A direction from the state in FIG. 16 so that the wiper leaves the ink ejection face.

When the wiper 35 moves further leftward (in the arrow A direction) to leave the ink ejection face F1 (to reach a position downstream of the ink ejection face F1 in the wiping direction), the leftward movement is stopped. When the wiper 35 leaves the ink ejection face F1, the bent wiper 35 straightens. Then as shown in FIG. 17, the control portion 110 descends the wiper 35. The cleaning liquid 23 and the waste ink wiped off by the wiper 35 are collected in a cleaning liquid collection tray (unillustrated) provided in the maintenance unit 19.

Finally, the control portion 110 moves the maintenance unit 19 arranged between the recording portion 9 and the first conveying unit 5 horizontally to arrange it under the second conveying unit 12, and ascends the first conveying unit 5 to a predetermined position. Recovery operation for the recording head 17 is thus finished.

In this embodiment, as described above, the depressed portion 40 is provided on the ink ejection face F1, downstream of the ink ejection region R1 in the wiping direction. The depressed portion 40 includes an upstream side inclined face 41 which inclines upward from the ink ejection face F1 to the downstream side in the wiping direction, and a downstream side inclined face 42 which inclines downward to the downstream side in the wiping direction. With this, when the wiper 35 passes across the downstream side inclined face 42, the purged ink 22 and the cleaning liquid 23 at the tip end portion of the wiper 35 are squeezed between the downstream side inclined face 42 and the wiper 35 and flow downward. This prevents the purged ink 22 and the cleaning liquid 23 from remaining at the tip end portion of the wiper 35, and it is thus possible to prevent the purged ink 22 and the cleaning liquid 23 at the tip end portion of the wiper 35 from splashing as a reaction of the bent wiper 35 straightening when the wiper 35 leaves the ink ejection face F1.

Thus, unlike in a case where the recording head is made to hold (capture) the purged ink at the tip end portion of the wiper as in conventional ink-jet recording apparatuses mentioned earlier, there is no need to provide a suction device for sucking in the purged ink held (captured) by the recording head, or to perform ink-suctioning operation after wiping operation by the wiper.

It is thus possible to prevent, with an easy configuration, the purged ink 22 and the cleaning liquid 23 at the tip end portion of the wiper 35 from splashing.

In a case where a depressed portion 40 has an upstream side perpendicular face which is perpendicular to the ink ejection face F1 and a downstream side perpendicular face which is arranged downstream of the upstream side perpendicular face in the wiping direction and is perpendicular to the ink ejection face F1, that is, in a case where the depressed portion 40 is formed to have a rectangular shape as seen in a cross-sectional view, when the wiper 35 passes across the upstream side perpendicular face, the purged ink 22 and the cleaning liquid 23 at the tip end portion of the wiper 35 enter the depressed portion 40 not to come out easily. When the wiper 35 passes across the downstream side perpendicular face, a middle part of the wiper 35 touches the downstream side perpendicular face (instead of the edge portion 35*a* of the tip end of the wiper 35 touching the downstream side perpendicular face, a position at a predetermined distance from the tip end of the wiper 35 touches the downstream side perpendicular face), and the purged ink 22 and the cleaning liquid 23 at the tip end portion of the wiper 35 enter the depressed portion 40 not to come out easily. That is, the purged ink 22 and the cleaning liquid 23 at the tip end portion of the wiper 35 are held (captured) in the depressed portion 40 on the ink ejection face F1.

If the depressed portion 40 is formed to have a rectangular shape as seen in a cross-sectional view, the purged ink 22 and the cleaning liquid 23 may attach to the tip end face 35*c* of the wiper 35 and splash when the wiper 35 leaves the ink ejection face F1.

As mentioned above, when the wiper 35 passes across the downstream side inclined face 42, the edge portion 35*a* at the tip end of the wiper 35 moves while keeping contact with the downstream side inclined face 42. With this, the purged ink 22 and the cleaning liquid 23 that have entered the depressed portion 40 can be wiped off by the wiper 35 (or can be pushed out of the depressed portion 40), and it is thus possible to prevent the purged ink 22 and the cleaning liquid 23 from remaining in the depressed portion 40.

As mentioned above, the downstream side inclination angle $\alpha$42 of the downstream side inclined face 42 to the ink ejection face F1 is smaller than the pressed contact angle $\alpha$35 of the tip end portion of the wiper 35 to the ink ejection face F1 in a state where the wiper 35 is wiping the ink ejection face F1. With this, when the wiper 35 passes across the downstream side inclined face 42, the edge portion 35*a* at the tip end of the wiper 35 can be moved easily while in contact with the downstream side inclined face 42.

As mentioned above, the difference in angle between the downstream side inclination angle $\alpha$42 and the pressed contact angle $\alpha$35 is smaller than or equal to five degrees. This makes the gap between the downstream side inclined face 42 and the wiper 35 small, and thus when the wiper 35 passes across the downstream side inclined face 42, the purged ink 22 and the cleaning liquid 23 at the tip end portion of the wiper 35 can flow downward easily by being squeezed between the downstream side inclined face 42 and the wiper 35. This sufficiently prevents the purged ink 22 and the cleaning liquid 23 from remaining at the tip end portion of the wiper 35.

As mentioned above, when the wiper 35 passes across the upstream side inclined face 41, the edge portion 35*a* at the tip end of the wiper 35 moves while keeping contact with the upstream side inclined face 41. With this, it is possible to prevent the purged ink 22 and the cleaning liquid 23 at the tip end portion of the wiper 35 from passing through the gap between the wiper 35 and the upstream side inclined face 41 to remain in the depressed portion 40.

As mentioned above, the upstream side inclination angle $\alpha$41 of the upstream side inclined face 41 to the ink ejection face F1 is smaller than the tip end face inclination angle $\alpha$35*c* of the tip end face 35*c* of the wiper 35 to the ink ejection face F1 in a state where the wiper 35 is wiping the ink ejection face F1. This permits, when the wiper 35 passes across the upstream side inclined face 41, the edge portion 35*a* at the tip end of the wiper 35 to easily move while keeping contact with the upstream side inclined face 41.

As mentioned above, the difference in angle between the upstream side inclination angle $\alpha$41 and the tip end face inclination angle $\alpha$35*c* is smaller than or equal to five degrees. This prevents the upstream side inclined face 41 from becoming long in the wiping direction, which thus prevents the depressed portion 40 from becoming large.

As mentioned above, the control portion 110 may make the moving speed of the wiper 35 when it passes across the downstream side inclined face 42 lower than the moving speed of the wiper 35 when it moves on the ink ejection face F1, or may stop the wiper 35 momentarily when it passes across the downstream side inclined face 42. Such a configuration can secure the time for the purged ink 22 and the cleaning liquid 23 squeezed between the downstream side inclined face 42 and the wiper 35 to flow down, and thus makes it easier for the purged ink 22 and the cleaning liquid 23 to flow down.

Figure 18:
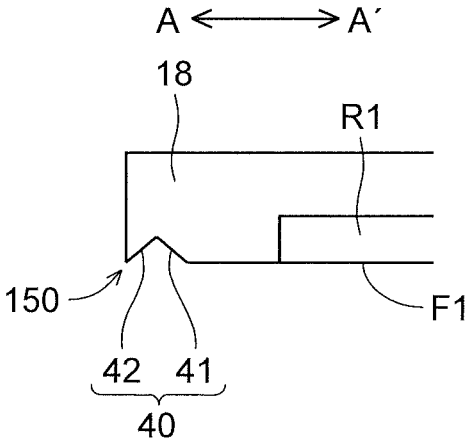
FIG. 18 is a diagram showing the structure where the downstream side inclined face and the downstream side of the recording head are formed continuously.

As mentioned above, the depressed portion 40 is arranged at the first distance L40 from a downstream-side end part of the ink ejection face F1 in the wiping direction. This prevents, unlike in a case where the depressed portion 40 is arranged in the downstream-side end part of the ink ejection face F1 (that is, in a case where the downstream side inclined face 42 and the downstream side of the recording head 17 are formed continuously), the bent wiper 35 from suddenly straightening when it has passed across the downstream side inclined face 42, and it is thus possible to prevent the purged ink 22 and the cleaning liquid 23 at the tip end portion of the wiper 35 from splashing. In a case where the downstream side inclined face 42 and the downstream side of the recording head 17 are formed continuously, as shown in FIG. 18, the connecting portion 150 between the downstream side inclined face 42 and the downstream side of the recording head 17 forms an acute angle, which makes the wiper 35 prone to be damaged when it passes the connecting portion 150. Thus, arranging the depressed portion 40 at the first distance L40 from the downstream-side end part of the ink ejection face F1 in the wiping direction can prevent the wiper 35 from being damaged.

As mentioned above, the upstream side inclined face 41 and the downstream side inclined face 42 are provided continuously, and the depressed portion 40 is formed in a triangular shape as seen in a cross-sectional view from the head width direction. This prevents the depressed portion 40 from becoming large in the wiping direction compared to in a case where the depressed portion 40 is formed, for example, in a trapezoid shape as seen in a cross-sectional view from the head width direction.

As mentioned above, on the upstream side of the recording head 17 relative to the ink ejection openings 18*a* in the wiping direction, a plurality of cleaning liquid supplying openings 60*a* for supplying the cleaning liquid 23 are provided. With this, the ink ejection face F1 can be cleaned with the cleaning liquid 23, and thus the ink ejection face F1 can be made cleaner than in a case where the ink ejection face F1 is cleaned only with the purged ink 22. The cleaning liquid 23 is less viscous than the purged ink 22, and thus the purged ink 22 at the tip end portion of the wiper 35 flows down more easily.

As mentioned above, the recording head 17 includes the head portion 18 with the ink ejection face F1, and the cleaning liquid supplying member 60 with the cleaning liquid supplying face F2 in which a plurality of cleaning liquid supplying openings 60*a* are provided. With this, the cleaning liquid supplying openings 60*a* can be formed more easily than in a case where the cleaning liquid supplying openings 60*a* are formed in the head portion 18.

The embodiments disclosed above should be understood to be in every aspect illustrative and not restrictive. The scope of the present disclosure is defined not by the description of the embodiments given above but by the appended claims, and should be understood to encompass any modifications made in the sense and scope equivalent to those of the claims.

For example, while the above embodiments deal with an example where recovery operation for the recording head 17 is performed using the ink (purged ink) 22 and the cleaning liquid 23, this is not meant to limit the present disclosure. Recovery operation for the recording head 17 may be performed using only the ink (purged ink) 22.

While the above embodiments deal with an example where the wiper 35 performs wiping operation only in one direction (the arrow A direction), this is in no way meant to limit the present disclosure. Instead, the wiper 35 may perform wiping operation in both directions (arrow AA' direction). That is, the wiper 35 may be reciprocated. In this case, the depressed portion 40 may be provided also in the arrow A' direction relative to the ink ejection openings 18*a*, and the cleaning liquid supplying openings 60*a* may be provided also in the arrow A direction relative to the ink ejection openings 18*a*.

Figure 19:
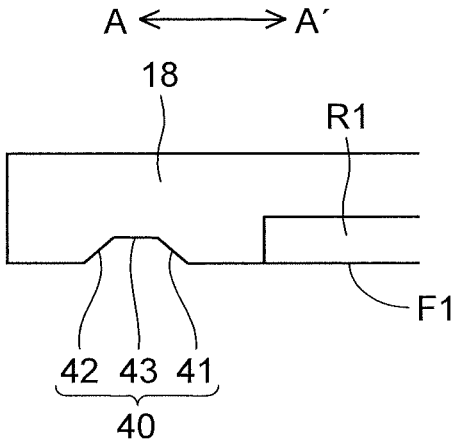
FIG. 19 is a diagram showing the structure of a head portion according to a first modified example of the present disclosure.

While the above embodiments deal with an example where the depressed portion 40 is formed in a triangular shape as seen in a cross-sectional view from the head width direction, this is in no way meant to limit the present disclosure. For example, as in the head portion 18 in a first modified example of the present disclosure shown in FIG. 19, the depressed portion 40 may be formed in a trapezoid shape as seen in a cross-sectional view from the head width direction. In this case, the depressed portion 40 may include the upstream side inclined face 41, the downstream side inclined face 42, and a flat portion 43 that is arranged between the upstream side inclined face 41 and the downstream side inclined face 42 and that extends in parallel with the ink ejection face F1.

Figure 20:
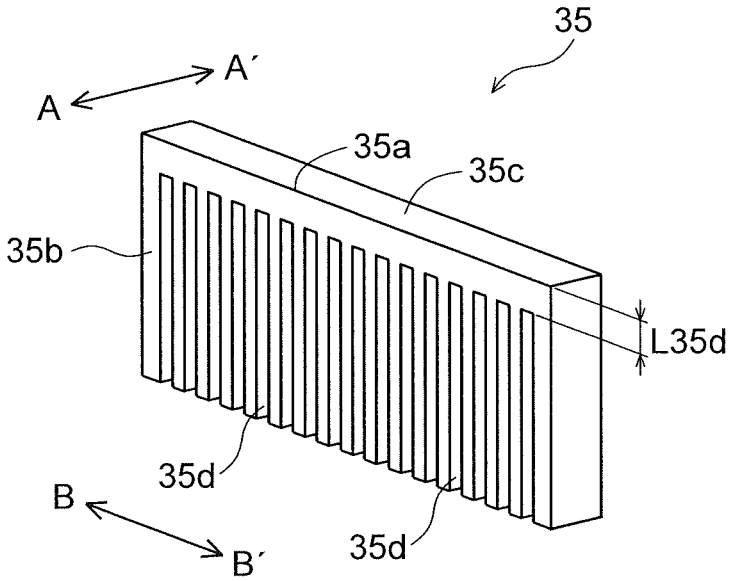
FIG. 20 is a diagram showing the structure of a wiper according to a second modified example of the present disclosure.

The wiping face 35*b* of the wiper 35 may be formed so that the purged ink 22 and the cleaning liquid 23 flow down more easily. For example, as in the wiper 35 in a second modified example according to the present disclosure shown in FIG. 20, a plurality of grooves 35*d* that extend in the up-down direction may be formed on the wiping face 35*b* at a second distance L35*d* from the tip end of the wiper 35. For example, the grooves 35*d* may have a width of about 1 mm (the length in the arrow BB' direction) and a depth of about 0.5 mm (the length in the arrow A direction) and may be formed with a pitch of about 2 mm in a wiper width direction (arrow BB' direction). Forming on the wiping face 35*b* a plurality of such grooves 35*d* extending in the up-down direction permits the purged ink 22 and the cleaning liquid 23 on the wiping face 35*b* of the wiper 35 to flow downward even more easily.

If a plurality of grooves 35*d* are formed from the top end of the wiping face 35*b*, the purged ink 22 and the cleaning liquid 23 pass through the grooves 35*d* during wiping operation. A plurality of grooves 35*d* thus need to be formed at a predetermined distance from the tip end of the wiper 35. In that case, it is less easy for the purged ink 22 and the cleaning liquid 23 at the tip end portion of the wiper 35 to reach the grooves 35*d*. In the present disclosure, however, when the wiper 35 passes across the downstream side inclined face 42, the purged ink 22 and the cleaning liquid 23 at the tip end portion of the wiper 35 are squeezed between the downstream side inclined face 42 and the wiper 35 and flow downward, and thus the purged ink 22 and the cleaning liquid 23 at the tip end portion of the wiper 35 can reach the grooves 35*d* easily. Thus the grooves 35*d* can exert a sufficient effect of letting the purged ink 22 and the cleaning liquid 23 flow downward.

When forming a plurality of grooves 35*d* on the wiping face 35*b* at the second distance L35*d* from the tip end of the wiper 35, it is preferable to set the second distance L35*d* to the substantially same length as the length of the downstream side inclined face 42 (about 2 to 3 mm) along the inclination direction. With this configuration, when the wiper 35 passes across the downstream side inclined face 42, the purged ink 22 and the cleaning liquid 23 that are pushed out by being squeezed between the downstream side inclined face 42 and the wiper 35 can reach the grooves 35*d* more easily.

Figure 21:
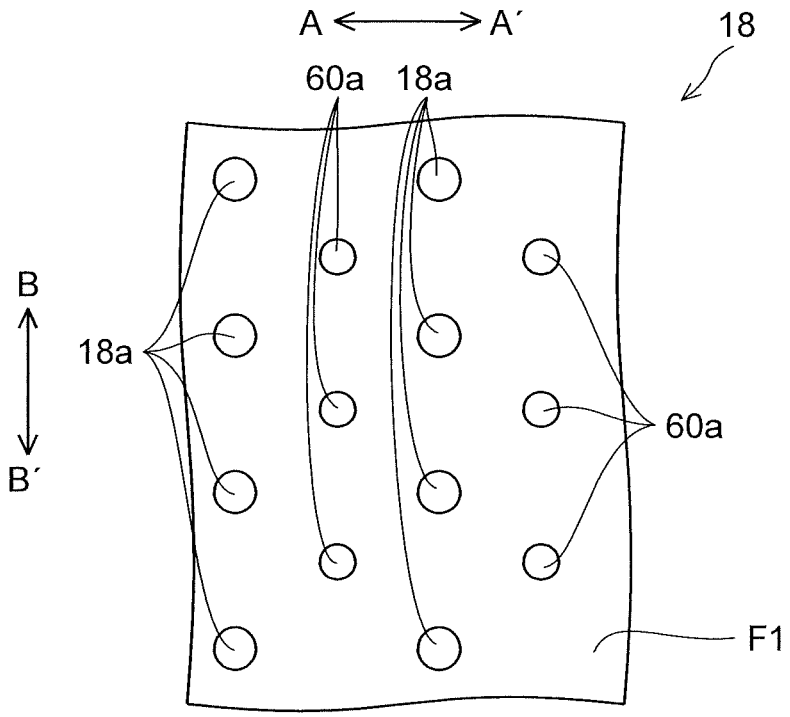
FIG. 21 is a diagram showing a head portion of a recording head according to a third modified example of the present disclosure as seen from below.

While the above embodiments deal with an example where the cleaning liquid supplying member 60 in which the cleaning liquid supplying openings 60*a* are formed is provided separately from the head portion 18, this is not meant to limit the present disclosure. Instead of the cleaning liquid supplying member 60 being provided, the cleaning liquid supplying openings 60*a* may be formed in the head portion 18. Here, as in the recording head 17 in a third modified example according to the present disclosure shown in FIG. 21, the cleaning liquid supplying openings 60*a* may be arranged adjacent to the ink ejection openings 18*a* (for example, the ink ejection openings 18*a* and the cleaning liquid supplying openings 60*a* may be arranged alternately).

While the above embodiments deal with an example where the wiper 35 stops the leftward movement after the wiper 35 has reached a position downstream of the ink ejection face F1 in the wiping direction, this is not meant to limit the present disclosure. The wiper 35 may stop the leftward movement and descend to leave the ink ejection face F1 when the wiper 35 has reached a position on the ink ejection face F1 downstream of the depressed portion 40 in the wiping direction.

Any configurations achieved by combining the configurations of the embodiments and modified examples described above are also within the technical scope of the present disclosure.

What is claimed is:

1. A head cleaning mechanism, comprising:

a recording head including an ink ejection face provided with an ink ejection region in which a plurality of ink ejection openings for ejecting ink onto a recording medium are open; and a wiper for wiping the ink ejection face in a predetermined direction, wherein a depressed portion extending in a head width direction perpendicular to a wiping direction in which the wiper wipes the ink ejection face is provided on the ink ejection face, downstream of the ink ejection region in the wiping direction, and the depressed portion includes:

an upstream side inclined face which inclines upward from the ink ejection face to a downstream side in the wiping direction; and a downstream side inclined face which is arranged on the downstream side of the upstream side inclined face in the wiping direction and which inclines downward to the downstream side in the wiping direction.

2. The head cleaning mechanism according to claim 1, wherein an edge portion of a tip end of the wiper on the downstream side in the wiping direction moves while keeping contact with the downstream side inclined face when the wiper passes across the depressed portion.

3. The head cleaning mechanism according to claim 2, wherein a downstream side inclination angle of the downstream side inclined face to the ink ejection face is smaller than a pressed contact angle of a tip end portion of the wiper to the ink ejection face in a state where the wiper is wiping the ink ejection face.

4. The head cleaning mechanism according to claim 3, wherein a difference in angle between the downstream side inclination angle and the pressed contact angle is equal to or smaller than five degrees.

5. The head cleaning mechanism according to claim 1, wherein an edge portion on the downstream side of a tip end of the wiper in the wiping direction moves while keeping contact with the upstream side inclined face when the wiper passes across the depressed portion.

6. The head cleaning mechanism according to claim 5, wherein an upstream side inclination angle of the upstream side inclined face to the ink ejection face is smaller than a tip end face inclination angle of a tip end face of the wiper to the ink ejection face in a state where the wiper is wiping the ink ejection face.

7. The head cleaning mechanism according to claim 6, wherein a difference in angle between the upstream side inclination angle and the tip end face inclination angle is equal to or smaller than five degrees.

8. The head cleaning mechanism according to claim 1, further comprising:

a control portion for controlling wiping operation in which the wiper wipes the ink ejection face, wherein the control portion makes a moving speed of the wiper passing across the downstream side inclined face lower than a moving speed of the wiper moving on the ink ejection face, or the control portion stops the wiper momentarily when the wiper passes across the downstream side inclined face.

9. The head cleaning mechanism according to claim 1, wherein the depressed portion is arranged at a first distance from a downstream side end part of the ink ejection face in the wiping direction.

10. The head cleaning mechanism according to claim 1, wherein the upstream side inclined face and the downstream side inclined face are provided continuously, and the depressed portion is formed in a triangular shape as seen in a cross-sectional view from the head width direction.

11. The head cleaning mechanism according to claim 1, wherein a flat portion is provided between the upstream side inclined face and the downstream side inclined face, and the depressed portion is formed in a trapezoid shape as seen in a cross-sectional view from the head width direction.

12. The head cleaning mechanism according to claim 1, wherein the wiper has a wiping face which is arranged on the downstream side in the wiping direction and which wipes the ink ejection face, and a plurality of grooves which extend in an up-down direction are formed on the wiping face at a second distance from a tip end of the wiper.

13. The head cleaning mechanism according to claim 12, wherein the second distance is substantially equal to a length of the downstream side inclined face along an inclination direction.

14. The head cleaning mechanism according to claim 1, wherein a plurality of cleaning liquid supplying openings for supplying a cleaning liquid are provided on the recording head, upstream of the ink ejection openings in the wiping direction.

15. The head cleaning mechanism according to claim 14, wherein the recording head includes an ink ejection head portion having the ink ejection face, and a cleaning liquid supplying head portion having a cleaning liquid supplying face in which a plurality of cleaning liquid supplying openings are provided.

16. An ink-jet recording apparatus comprising the head cleaning mechanism according to claim 1.

* * * * *